United States Patent [19]

Luhman et al.

[11] Patent Number: 4,781,782

[45] Date of Patent: Nov. 1, 1988

[54] WEB APPLICATOR

[75] Inventors: Robert A. Luhman, Deer Park, Wis.; Kent S. Tarbutton, Lake Elmo, Minn.; Rudolf I. Shvartsman, Ballston Lake, N.Y.; Donald J. Geisel, Clifton Park, N.Y.; Richard J. Pilarski, Saratoga, N.Y.

[73] Assignee: Minnesota Mining and Manufacturing Company, St. Paul, Minn.

[21] Appl. No.: 34,759

[22] Filed: Apr. 6, 1987

[51] Int. Cl.[4] ..... B65H 16/00; B65H 77/00

[52] U.S. Cl. ..... 156/361; 156/363; 156/523; 156/527; 156/574; 156/577

[58] Field of Search ..... 156/361, 363, 523, 527, 156/574, 577, 362, 494; 226/44

[56] References Cited

U.S. PATENT DOCUMENTS

| | | | |
|---|---|---|---|
| 3,667,664 | 6/1972 | Schroeder | 226/44 X |
| 3,970,831 | 7/1976 | Hegyi | 235/151.1 |
| 4,255,218 | 3/1981 | Stageberg | 156/361 X |
| 4,292,108 | 9/1981 | Weiss et al. | 156/259 |
| 4,328,061 | 5/1982 | Off et al. | 156/353 |
| 4,351,688 | 9/1982 | Weiss et al. | 156/358 |
| 4,419,170 | 12/1983 | Blad | 156/552 X |
| 4,461,669 | 7/1984 | Dontscheff | 156/577 X |
| 4,508,584 | 4/1985 | Charles | 156/527 X |

FOREIGN PATENT DOCUMENTS 2101519 of 0000 United Kingdom .

*Primary Examiner*—Michael W. Ball
*Assistant Examiner*—Jeff H. Aftergut
*Attorney, Agent, or Firm*—Donald M. Sell; John C. Barnes

[57] ABSTRACT

A taping head for applying a film of pressure sensitive adhesive to a receptor surface has a drive means for driving the adhesive to the applicating roller by driving a liner supporting the adhesive, and a dancing roll positioned between the apparatus for stripping the liner from the adhesive and the applicating roller adjusts the speed of movement of the film of adhesive to match the same with the application of the adhesive. The applicator is pressed against the receptor surface under the control of a compression device and a cutting device for adhesive severs the adhesive below the applicating roller and an air nozzle maintains the cut end of the adhesive in a position for subsequent application.

13 Claims, 4 Drawing Sheets

WEB APPLICATOR

BACKGROUND OF THE INVENTION

1. Field of the Invention

This invention relates to applicators for applying lengths of web material to a surface.

2. Description of the Prior Art

The prior art web applicators for applying a length of web material to a surface, such as tape heads where the web was coated with a pressure sensitive adhesive, the receptor was either driven past the applicating head and the web was applied to the receptor surface or the head was moved and the article remained stationary, and such relative movement of the head and surface dispensed the web onto the surface. Cutting means were provided for cutting the web at a predetermined time interval or upon a predetermined length of tape being dispensed.

Other tape applicators include applicators for applying pressure sensitive adhesive labels to a product. These applicating heads are stationary. As the product to be labeled moved by, a drive means moved a liner around a stripping edge to separate the liner from the pressure sensitive adhesive coated label. The separated label was then applied to the surface of the article as the same moved past the label applicating head.

Differing from these prior art devices, the device of the present invention provides a drive means for an adhesive web which is separated from a liner and applied by an applicating roller to a stationary surface as the head is moved about the surface by an automatically controlled mechanism such as a robotic arm which is attached to the frame of the applicating head in a manner that it will permit the head to position the applicating roller on the surface and rotate on the automatially controlled mechanism as a portion of that mechanism on which the applicating head is mounted moves along X, Y and Z coordinates to manipulate the position, height and speed of the applicating head.

SUMMARY OF THE INVENTION

The present invention provides an applicator adapted for use with an automatically controlled mechanism such as a robotically driven arm for applying a length of a web to a surface. The web may comprise a film of pressure sensitive adhesive on a liner. A stripping plate is supported on a frame for the applicator and has an edge about which the liner is drawn to separate the liner from the web and a drive for driving the liner including a drive roller having positive engagement with the liner. The liner draws the web material off the liner to the applicating roller. The applicating roller is freely rotatable in one direction.

A dancing roller is disposed between the separating edge and the applicating roller and is engageable with said web. A spring member connected to the dancing roller positions said dancing roller and the dancing roller is also connected to means responsive to movement of said dancing roller for controlling the operation of the liner drive. The applicating roller is pressed toward the product surface with a controlled pressure from an air cylinder against the bias of two leaf springs.

BRIEF DESCRIPTION OF THE DRAWINGS

The present invention will be described in greater detail with reference to the accompanying drawing wherein.

DETAILED DESCRIPTION

Figure 1:
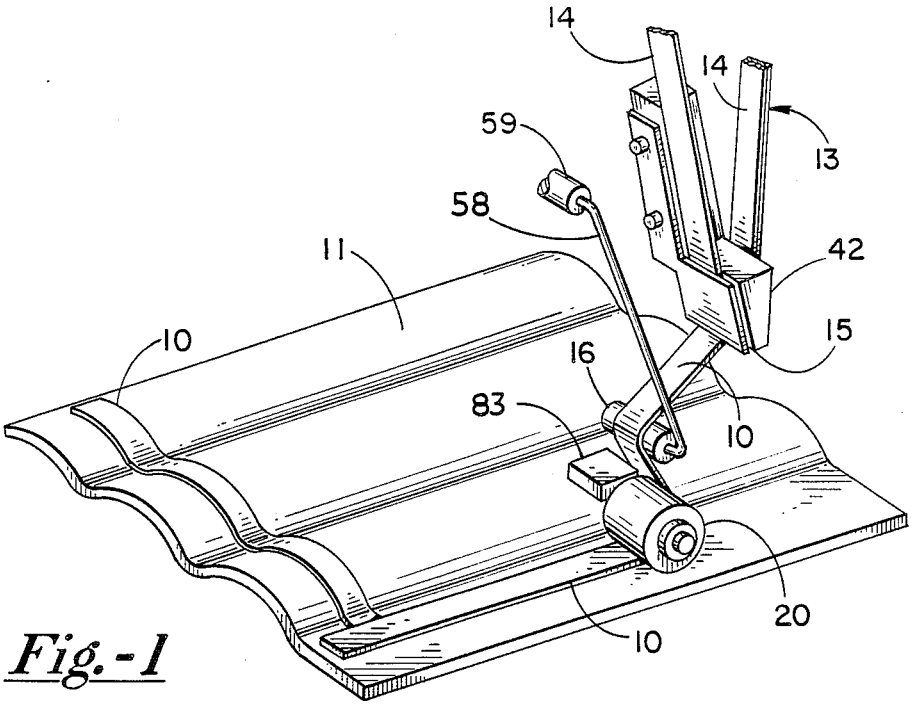
FIG. 1 is a schematic view of the tape applicating head of the present invention applying lengths of tape to the surface of a stationary article.

The present invention provides a web applicating head which may be used, as illustrated, to apply a web of adhesive material such as a film of pressure sensitive adhesive supplied on a liner to a product, which web of adhesive is illustrated at 10 in FIG. 1 to the surface of a stationary product 11. The present invention provides means for applying the film of adhesive or other material to a surface at essentially zero tension. Thus the film is applied at the speed of movement of the head. This permits the adhesive to be applied to a surface that may have a film of lubricant on the surface and the film will remain where it is placed. The applicator can be used for a web of pressure sensitive adhesive in applications where a bead of adhesive or sealant was previously used.

The applicating head is located on a portion of an automatically controlled mechanism such as a robotically controlled arm which portion has movement on the X, Y and Z axis such that it can receive instruction on the Z axis to determine the height of the head with respect to the surface and on the X and Y axis to determine its position or its rate of movement in any direction with respect to the Z axis, and universal movement for positioning the applicating roller at varying angles to maintain contact with a product surface. The illustrated taping application is provided using a web of pressure sensitive adhesive or a tape with pressure sensitive adhesive on either side or both sides of a backing. In either event, the web is provided on a liner and the liner is separated from the pressure sensitive adhesive. The adhesive is supplied on the liner in a convolutely wound roll for use in this application. The roll of tape material 13 may be supported on the frame of the applicating head or remotely stored and directed along a guide member to the head.

At the applicating head the tape web 13 is guided along a plate to an edge 15 for separating the liner 14 from the adhesive 10 of web 13. The adhesive is then directed around a dancing roller 16 to an applicating roller 20 which presses one surface of the adhesive into contact with the surface of the stationary member 11.

Referring now to the other figures where the head is disclosed in greater detail, but like parts are referred to by the same number throughout the several views, the applicating head is provided with a frame 21 having a bracket 22 attached thereto at the upper edge of the frame 21 to secure the head to the portion of the automatically controlled mechanism.

As illustrated, the frame 21 includes a transverse bar 24. Depending from one end of the bar 24 is a bracket 25 which supports a spool 26 which will support a supply roll 27 of the web material. Positioned at the opposite end of the bar 24 is another bracket bar 29 from which is supported a spindle 30 for supporting a take-up reel 31. Between the bracket 25 and the bracket 29 is a frame member 33 which supports a liner drive mechanism 34, a liner stripping mechanism 35, a web sensing and speed control system generally designated 36, a cutting mechanism 38 and applicating roller 20.

Figure 2:
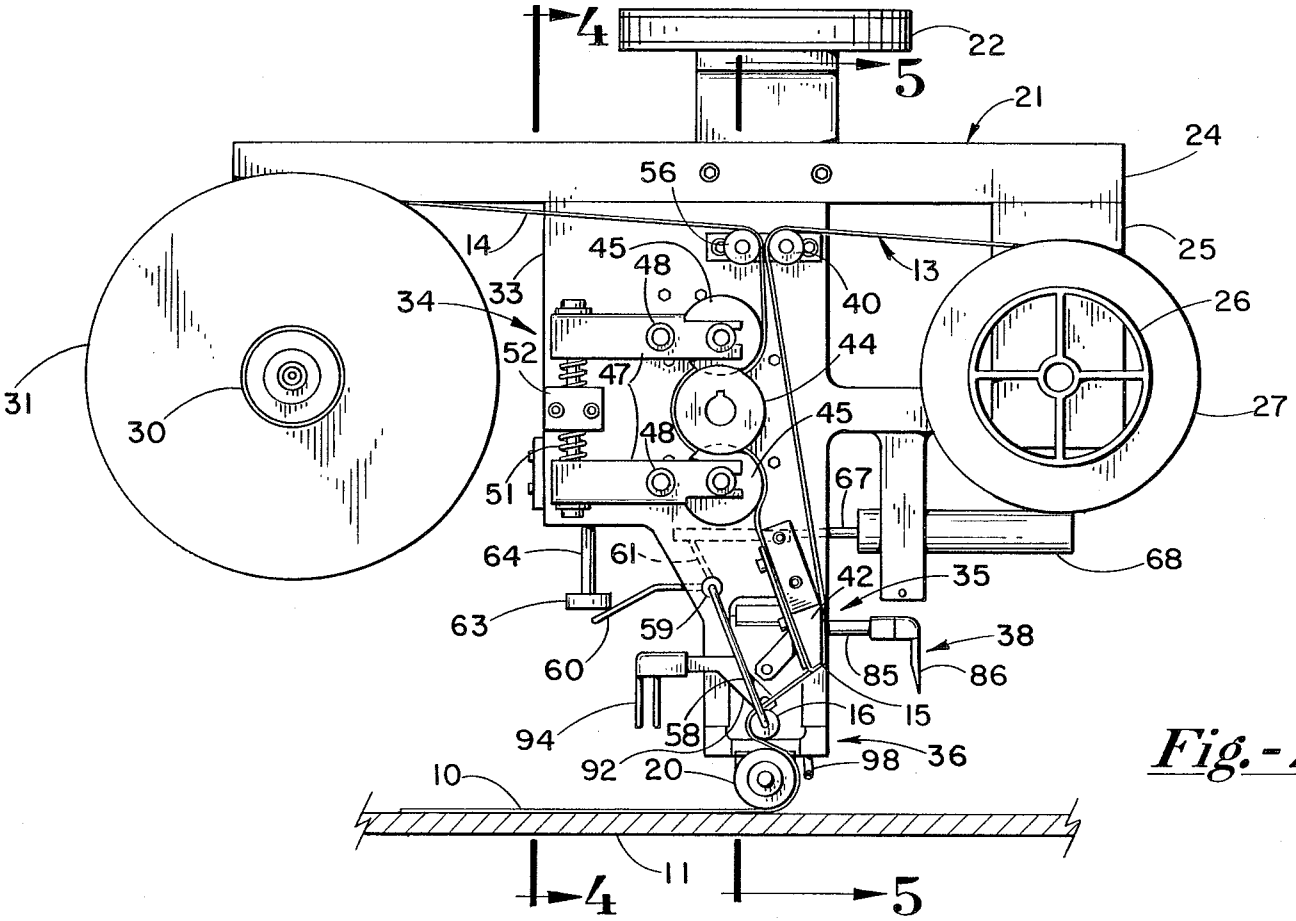
FIG. 2 is a side elevational view of the applicating head of the present invention.
Figure 3:
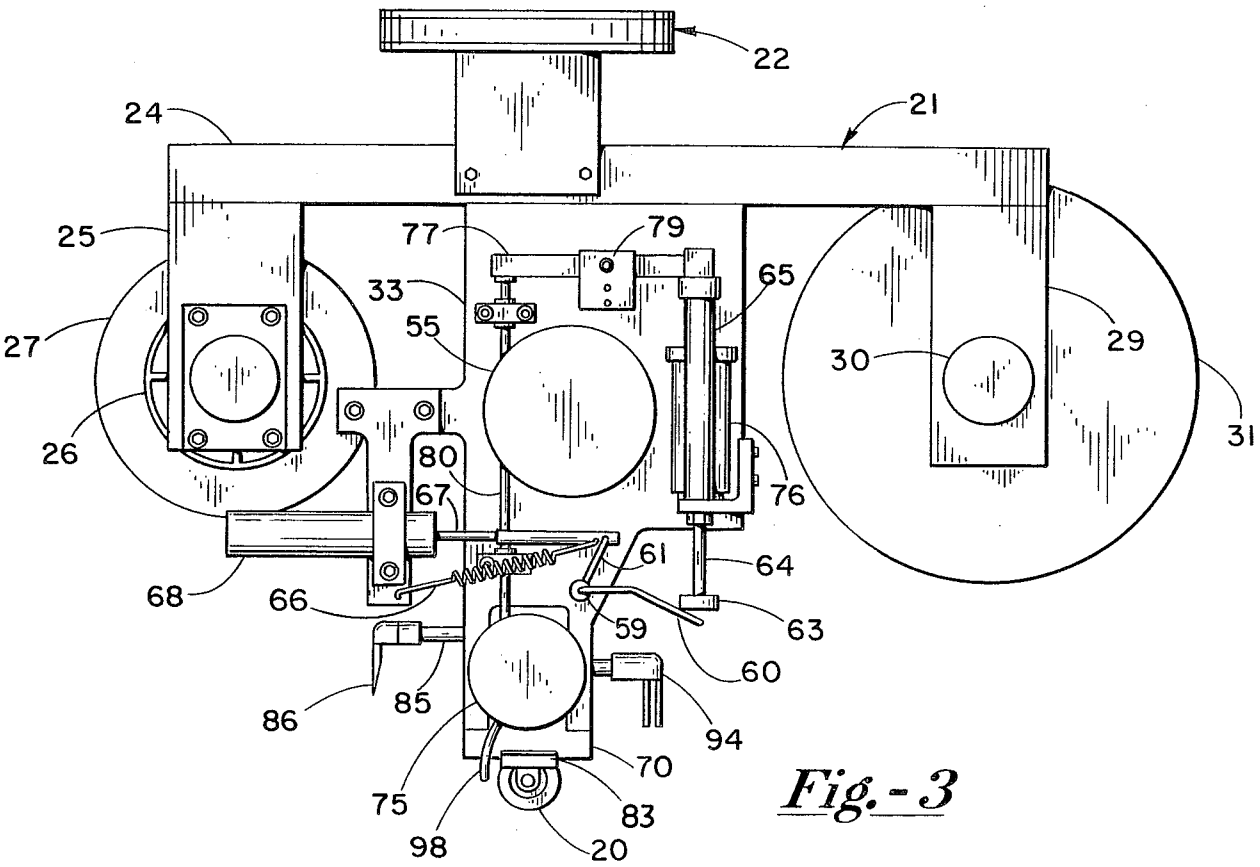
FIG. 3 is a rear elevational view of the applicating head of the present invention.
Figure 5:
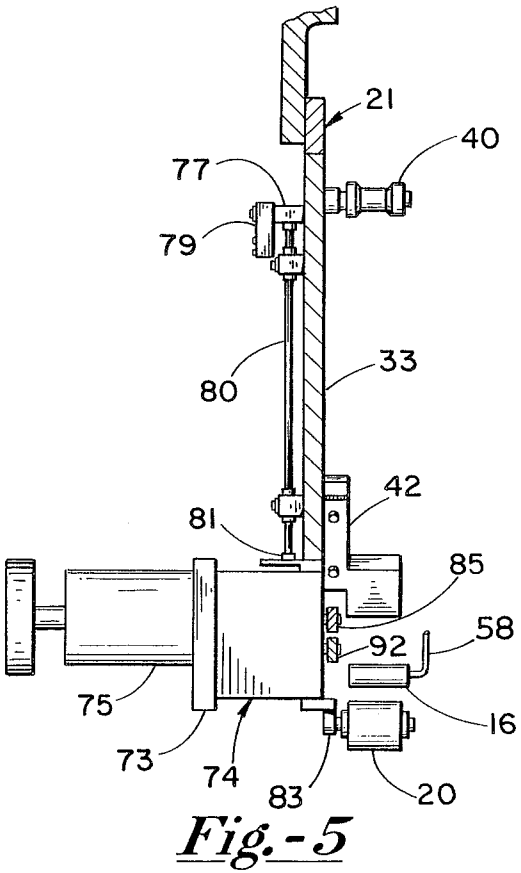
FIG. 5 is a vertical sectional view taken along the lines 5—5 of FIG. 2.
Figure 4:
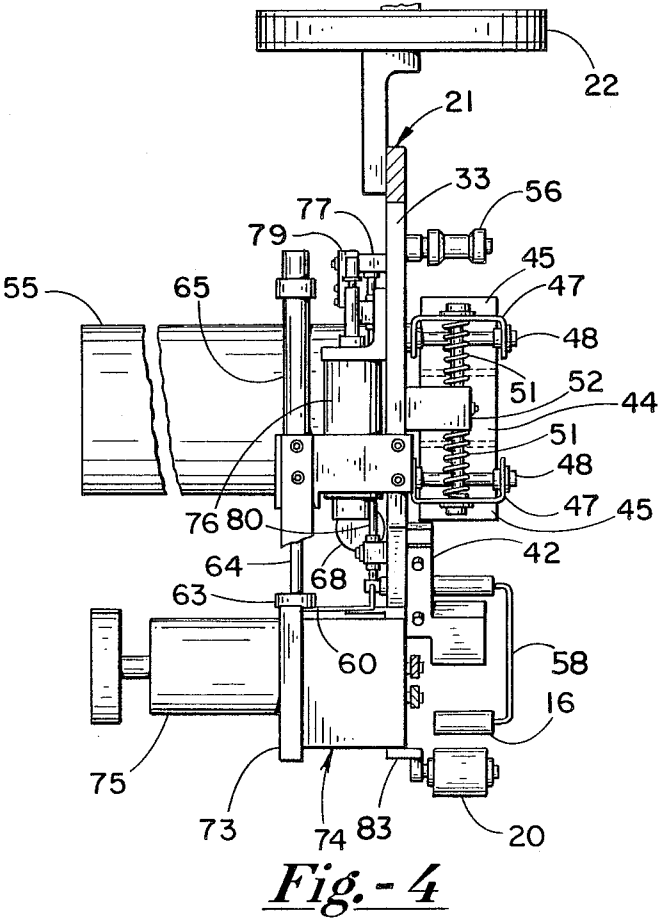
FIG. 4 is a vertical sectional view of the applicating head of the present invention taken along the lines 5—5 of FIG. 2.

Referring first to the drive mechanism, the web is removed from the supply spool 26 and is directed around a first idler 40 from which the web is directed to the liner separating or striping mechanism 35. This mechanism 35 includes a plate 42 having two edge guide plates and an edge 15 about which the liner 14 is directed to separate the same from the pressure sensitive adhesive 10. The liner 14 goes around the edge 15 and along the opposite side of the plate 42 between said opposite side and a deflector plate 43. The deflector plate 43 provides only a thin gap between it and plate 42 to restrict the adhesive 10 from following the liner 14. The liner 14 moves from between the deflector plate 43 and plate 42 to the liner drive mechanism 34. The liner drive 34 comprises a drive roller 44 which is supported on the frame 33. On either side of the drive roller 44 is a pressure roller 45 which pressure rollers 45 are supported in yokes 47 which are pivoted about axes 48 to move the pressure rollers into firm contact with diametrically opposite surfaces of the drive roller 44. This firm contact is maintained by a pair of springs 51 which are disposed on either side of a fixed spring block 52 which supports the springs 51. The springs engage the yokes for the pressure rollers 45 for urging the same about their pivot axes 48 in a direction towards the periphery of the drive roller 44. The drive roller 44 is driven by a servo motor 55, as shown in FIGS. 3 and 4, to drive the drive roller 44 at varying speeds. As the drive roller 44 is driven in the clockwise direction as seen in FIG. 2, the liner will be drawn around the edge 15, causing a separation of the adhesive 10 from the liner 14. From the second of the pressure rollers 45 the liner 14 goes around a guide roll 56 to the take-up reel 31 driven by the driven spindle 30. The spool 26 and the spindle 30 are driven by 24 volt motors which provide a braking action to the spool 26 and a take-up drive to the spindle 30.

After the adhesive is separated from the liner 14, the adhesive is directed toward the applicating roller 20. Positioned between the separating edge 15 and the applicating roller 20 is a dancing roll 16. The dancing roll 16 is mounted on the end of a crank arm 58 joined to an axle 59 supported on the frame 33. Extending from the opposite end of the axle 59 is a first radial arm 60 and a second radial arm 61. The radial arm 60 extends from the axle 59 to a position for engagement with the end 63 of a rod 64 extending from an air cylinder 65. The cylinder 65 is actuated prior to operation of the cutting mechanism 38 to force the end 63 against the arm 60 to rotate the axle 59 and thus the crank arm 58. The amount of movement is sufficient to move the dancing roll 16 from its normal position to a fixed position more nearly along a line between the edge 15 and the applicating roller 20. When the next web application begins the severed end of the web is positioned below the applicating roller 20, the liner drive starts and the dancing roll 16 is released to return to its normal operating position under the force of a tension spring 66 connected to frame 33 and radial arm 61.

The spring 66 then draws the adhesive 10 to the operating path and any changes in tension on the adhesive web are reflected by movement of the dancing roller 16 and thus movement of the second radial arm 61 which is also connected to the end of a rod 67 extending from a linear potentiometer or voltage transducer 68. The device 68 is referred to as a linear variable differential transducer or LVDT and one variety Type 200 DC-D is available from Schaevitz Engineering, Pennsauken, New Jersey. In any event, movement of the rod 67 with respect to the transducer 68 affords means to control the rotational speed of the liner drive servo motor 55. The change in position of the rod 67 in the transducer 68 causes a change in the current to the drive motor 55, affording a change in the rotation of the drive roller 44. Thus, if there is excessive tension on the adhesive 10, the drive roller 44 will accelerate. If the tension goes out of the adhesive 10 the drive roller 44 will slow down. Changes in web feed speed are controlled by the program for the robotic arm and the dancer roll 16 only makes fine adjustments in the web tension such as when the adhesive is applied at a corner or curve or when the applicating roller position is moved from a horizontal path to a vertical path.

The applicating roller 20 is mounted on the head by a one way bearing for free rotation clockwise as seen in FIG. 2. The roller 20 has an outer surface formed to avoid adhesion to the adhesive web, e.g. knurled, silicone coated, Teflon coated, plasma coated etc. The roller 20 is mounted on a subframe 70 which is spring mounted with respect to the frame 33 and is movable therewith by means of two leaf springs 71 and 72 cantilevered from a fixed support plate 73 of a housing 74 mounted at the bottom of the frame 33. On this housing 74 is mounted a rotary double acting cylinder 75 which drives the cutting mechanism 38 for the adhesive web. The subframe 70, which is formed like a window frame and supported on the ends of the springs 71 and 72, is movable with respect to the frame 33 by the springs and against the bias of the springs by a damping device including an air cylinder 76 connected to a rocking arm 77 pivoted about an axis 79. The rocker arm 77 has the other end connected to a vertical rod 80 having an end member 81 which engages a plate member 82 mounted at the top of the frame 70. The two springs 71 and 72 of flat stock provide a parallelogram support for the applicating roller 20. The applicating roller 20 is supported on a shaft and journalled on a one way bearing in cantilever fashion from a support member 83 affixed to the bottom of the frame 70. In operation the cylinder 76 is pressurized to apply a force against the plate 82 and force the applicating roller 20 into contact with the product surface to afford contact between the adhesive 10 and the product surface.

Figure 6:
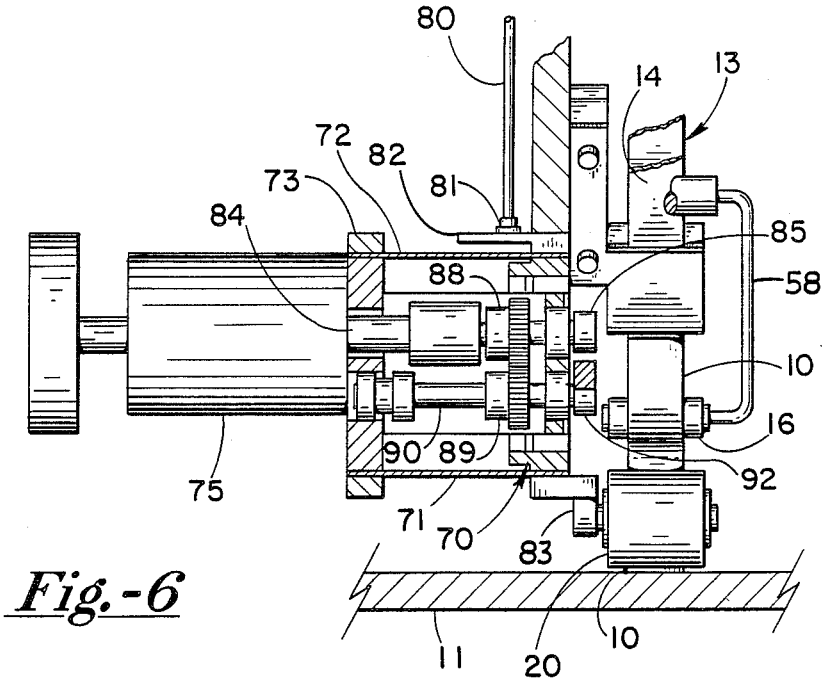
FIG. 6 is an enlarged sectional view of the lower end of the applicating head.

Referring now to the cutting mechanism and FIGS. 2, 3, and 6, the rotary double acting air cylinder 75 has a primary drive shaft 84 movable through an angle of 90°, which shaft 84 extends through the housing 74. The end of shaft 84 is fixed to a radial arm 85 on which a knife 86 is attached. A gear 88 is fixed to the shaft 84, intermediate the radial arm 85 and the cylinder 75, which gear meshes with a second gear 89 fixed on a parallel shaft 90. The shaft 90 is supported in the housing 74 by suitable bearings. One end of shaft 90 is attached to a radial arm 92 on the distal end of which is an anvil member 94 cooperating with the knife 86 to sever the adhesive 10 by the knife bursting through the web backed by the anvil when the cylinder 75 is driven in one direction and bringing the arm 85 and the arm 92 back to their normal rest positions when reversed. The automatically controlled mechanism has lifted the applicator when it is desired to sever the adhesive 10. When the cylinder 75 is reversed, to rapidly separate the anvil and knife, approximately one-half inch (1.27 cm) of adhesive web remains extending below the applicating roller 20.

An air nozzle 98 is provided adjacent the periphery of the applicating roller 20 to maintain the severed length of tape against the surface of the applicating roller such that the web end is positioned to engage the surface of the stationary member 11 when the automatically controlled mechanism places the applicating head against the work surface again.

The guide roller 40, dancing roll 16 and applicating roller 20 are all provided with an outer covering or surface to resist adhesion of the adhesive of web 10 to such members.

Having thus disclosed the present invention with reference to a preferred embodiment thereof, it will be appreciated that changes can be made therein without departing from the scope of the invention as set forth in the appended claims. For example, rather than being mounted on an automatically controlled mechanism the frame of the applicator may be fixed and the surface to which the web material is to be attached may be moved, or both the frame of the applicator and the surface to which the web material is to be attached may be moved to provide the relative movement between the head and the surface required for proper application of the film. Also, the supply and take-up spools for the applicator may be mounted on structures other than the frame of the applicator.

We claim:

1. A web applicator for applying to a surface a length of web material carried releasably on a liner, said applicator comprising:

a frame, guide means directing a supply of web material to the frame, a stripping plate supported on said frame and having an edge about which the liner of a said web material is drawn to separate the liner from the web, drive means for driving said liner including a drive roller having positive engagement only with said an applicator roller supported on said frame in spaced relationship to said edge, a dancing roller disposed between said edge and said applicating roller and positioned transversely to and engageable only with said web, means for positioning said dancing roller to define the normal path of said web, and means responsive to movement of said dancing roller for controlling the rate of rotation of said drive roller.

2. An applicator according to claim 1 wherein said positioning means for said dancing roller comprises a spring and an air cylinder is provided to move said dancing roller to a set position by applying a force to change the position of the dancing roller against the bias of said spring.

3. An applicator according to claim 2 wherein said means responsive to movement of said dancing roller for controlling said drive roller comprises a linear transducer having the armature movable in response to movement of the position of the axis of the dancing roller.

4. An applicator according to claim 3 wherein said drive means for said liner includes a servo motor responsive to changes in position of said armature to said transducer for varying the speed of said drive roller.

5. An applicator according to claim 1 wherein said applicating roller is supported on a subframe which is spring mounted to said frame.

6. An applicator according to claim 5 wherein means are provided for forcing said subframe in a direction toward a receptor surface to maintain a predetermined amount of force between said applicating roller and said receptor surface for uniformly applying a said web to a said receptor surface.

7. An applicator according to claim 1 wherein said frame includes a bracket at the upper edge thereof to secure said applicator to an automatically controlled mechanism affording a raising and lowering or rotation of said applicator for substantially universal positioning of said applicating roller.

8. An applicator according to claim 6 wherein said subframe is supported from two parallel flat spring members in spaced relationship to afford a parallelogram support for said applicating roller.

9. An applicator according to claim 8 wherein said means for forcing said subframe toward a receptor surface comprises a linear acting air cylinder for applying unidirectional pressure against said subframe to bias the same against said flat spring members toward the receptor surface.

10. An applicator according to claim 1 wherein said applicator includes cutting means for severing a said web between a receptor surface and said applicating roller.

11. An applicator according to claim 10 wherein said cutting means comprises a knife and anvil between which said web is severed.

12. An applicator according to claim 11 wherein said knife and anvil are mounted on oscillating arms driven by a double acting air cylinder.

13. An applicator according to claim 10 wherein means are provided for retaining the severed end of the web adjacent the applicating roller after operation of said cutting means.

* * * * *

UNITED STATES PATENT AND TRADEMARK OFFICE

CERTIFICATE OF CORRECTION

PATENT NO. : 4,781,782

DATED : November 1, 1988

INVENTOR(S) : Robert A. Luhman, et al

It is certified that error appears in the above-identified patent and that said Letters Patent is hereby corrected as shown below:

Column 1, line 38, insert --such-- before "that".

Claim 1, Column 5, line 52, "applicator" should be --applicating--.

Signed and Sealed this

Eighth Day of August, 1989

*Attest:*

DONALD J. QUIGG

*Attesting Officer*

*Commissioner of Patents and Trademarks*